US011622189B2

(12) United States Patent
Qin et al.

(10) Patent No.: US 11,622,189 B2
(45) **Date of Patent: *Apr. 4, 2023**

(54) SPEAKER AND MOBILE TERMINAL

(71) Applicant: Huawei Technologies Co., Ltd., Shenzhen (CN)

(72) Inventors: Renxuan Qin, Shanghai (CN); Shizhe Li, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/718,006

(22) Filed: Apr. 11, 2022

(65) Prior Publication Data

US 2022/0240002 A1 Jul. 28, 2022

Related U.S. Application Data

(63) Continuation of application No. 17/256,370, filed as application No. PCT/CN2018/093848 on Jun. 29, 2018, now Pat. No. 11,330,363.

(51) Int. Cl.
*H04R 1/28* (2006.01)
*H04R 1/34* (2006.01)
(Continued)

(52) U.S. Cl.
CPC ..... *H04R 1/2811* (2013.01); *H04R 1/345* (2013.01); *H04R 9/022* (2013.01); *H04R 9/06* (2013.01);
(Continued)

(58) Field of Classification Search
CPC ..... H04R 1/2811; H04R 1/345; H04R 9/022; H04R 2400/03; H04R 2499/11
(Continued)

(56) References Cited

U.S. PATENT DOCUMENTS 9,363,587 B2 6/2016 Weiss et al.
9,986,321 B1 5/2018 She
(Continued)

FOREIGN PATENT DOCUMENTS

CN 102711004 A 10/2012
CN 204291369 U 4/2015
(Continued)

OTHER PUBLICATIONS

U.S. Appl. No. 17/256,370, filed Dec. 28, 2020.
(Continued)

*Primary Examiner* — Sean H Nguyen
(74) *Attorney, Agent, or Firm* — Leydig, Voit & Mayer, Ltd.

(57) ABSTRACT

This application provides a speaker and a mobile terminal. The speaker includes a housing and a kernel located in the housing, where there is a front cavity and a rear cavity in the housing, the front cavity is in communication with the outside, and the rear cavity is an isolated cavity. In addition, to reduce a space area occupied by the entire speaker, the front cavity and the rear cavity are disposed in a stacked manner when being disposed. Specifically, the front cavity and the rear cavity are at least partially stacked along a thickness direction of the kernel. Therefore, the rear cavity is disposed in space of the entire speaker in the thickness direction of the kernel, to reduce an area occupied by the entire speaker in the mobile terminal on the premise that a size of the rear cavity meets a requirement.

20 Claims, 6 Drawing Sheets

(51) Int. Cl.
*H04R 9/02* (2006.01)
*H04R 9/06* (2006.01)

(52) U.S. Cl.
CPC ..... *H04R 2400/03* (2013.01); *H04R 2499/11* (2013.01)

(58) Field of Classification Search
USPC ..... 381/345
See application file for complete search history.

(56) References Cited

U.S. PATENT DOCUMENTS

| | | | |
|---|---|---|---|
| 2011/0085684 | A1 | 4/2011 | Kim et al. |
| 2015/0023544 | A1 | 1/2015 | Chu |
| 2016/0127834 | A1 | 5/2016 | Kim et al. |
| 2016/0295316 | A1 | 10/2016 | Shao et al. |
| 2016/0314779 | A1 | 10/2016 | Huang |
| 2017/0070796 | A1 | 3/2017 | Miao et al. |
| 2017/0311061 | A1 | 10/2017 | Miao et al. |
| 2018/0139389 | A1 | 5/2018 | Park et al. |
| 2018/0152790 | A1 | 5/2018 | Dong et al. |

FOREIGN PATENT DOCUMENTS

| | | | |
|---|---|---|---|
| CN | 104602168 | A | 5/2015 |
| CN | 204350287 | U | 5/2015 |
| CN | 204948357 | U | 1/2016 |
| CN | 206226704 | U | 6/2017 |
| CN | 206332841 | U | 7/2017 |
| CN | 206433153 | U | 8/2017 |
| CN | 107592598 | A | 1/2018 |
| CN | 107613415 | A | 1/2018 |
| CN | 107690113 | A | 2/2018 |
| CN | 207070349 | U | 3/2018 |
| CN | 107959914 | A | 4/2018 |
| CN | 207219033 | U | 4/2018 |
| JP | 2010258720 | A | 11/2010 |
| KR | 20160089459 | A | 7/2016 |
| KR | 20180022195 | A | 3/2018 |
| RU | 2347326 | C2 | 2/2009 |
| RU | 2469496 | C1 | 12/2012 |
| WO | 2011045894 | A1 | 4/2011 |

OTHER PUBLICATIONS

S. Josefsson,"The Base16, Base32, and Base64 Data Encodings," Network Working Group, Request for Comments: 4648, total 18 pages (Oct. 2006).

T. Bray, Ed., "The JavaScript Object Notation (JSON) Data Interchange Format," Internet Engineering Task Force (IETF), Request for Comments: 7159, total 16 pages (Mar. 2014).

M. Jones, "JSON Web Key (JWK)," Internet Engineering Task Force (IETF), Request for Comments: 7517, total 40 pages (May 2015).

SPEAKER AND MOBILE TERMINAL

CROSS-REFERENCE TO RELATED APPLICATIONS

This application is a continuation of U.S. patent application Ser. No. 17/256,370, filed on Dec. 28, 2020, which is a national stage of International Application No. PCT/CN2018/093848, filed on Jun. 29, 2018. Both of the aforementioned applications are hereby incorporated by reference in their entireties.

TECHNICAL FIELD

This application relates to the field of acoustic equipment technologies, and in particular, to a speaker and a mobile terminal.

BACKGROUND

With improvement of users' life quality, users are increasingly pursuing ultimate audio-visual experience. Therefore, there is a very urgent requirement for integrating a higher-quality SPK into a mobile phone in limited space and implementing stereophonic sound by using two SPKs. A common mobile phone includes one SPK speaker (horn) and one REC receiver (earpiece). FIG. 1 shows a top view of a speaker in the prior art. FIG. 2 shows a schematic exploded view of the speaker. FIG. 3 shows a sectional view at a line A-A in FIG. 1. FIG. 4 shows a sectional view at a line B-B in FIG. 1. It can be seen from FIG. 1 and FIG. 2 that the speaker includes three components: a kernel 2, an upper cover 3, and a lower cover 4. The upper cover 3 and the lower cover 4 are sealed to form a housing 1, and the kernel 2 is disposed in the housing 1. In addition, the housing 1 includes a front cavity 5 and a rear cavity 6. A sound production path is formed in the front cavity 5 enclosed by the lower cover 4 and the kernel 2, and is directly connected to the outside through a sound production port. An internal air flow loop is formed in the sealed rear cavity 6 enclosed by the upper cover 3, the kernel 2, and the lower cover 4. The rear cavity 6 needs a specific volume to meet performance indicators FO and a frequency response. As shown in FIG. 1 and FIG. 3, the front cavity 5 and the rear cavity 6 are arranged side by side. For ease of description, a coordinate system XYZ is established, where an XY plane is a placement plane of the speaker, and a Z direction is a thickness direction of the speaker. It can be seen from FIG. 3 that, in the prior art, the front cavity 5 and the rear cavity 6 are arranged side by side on the XY plane. Consequently, a relatively large area is occupied by the entire speaker in a mobile terminal.

SUMMARY

This application provides a speaker and a mobile terminal, to reduce an area occupied by the speaker in the mobile terminal, and improve space utilization of the mobile terminal.

According to a first aspect, a speaker is provided. The speaker includes a housing and a kernel, where the housing includes a side frame, an upper cover plate, and a lower cover plate disposed opposite to the upper cover plate, and the upper cover plate and the lower cover plate are configured to seal two openings of the side frame; a spacer is further disposed in the housing, the kernel is disposed between the upper cover plate and the spacer, and the kernel and the spacer are disposed in a stacked manner along a thickness direction of the kernel; in addition, when cavities are formed, the kernel, the spacer, and side walls of the side frame enclose a front cavity, and a sound hole in communication with the front cavity is disposed on a side wall of the side frame; in addition, the upper cover plate, side walls of the kernel, and the side walls of the side frame enclose a first rear cavity; the lower cover plate, the side walls of the side frame, and the spacer enclose a second rear cavity, and the first rear cavity is in air communication with the second rear cavity; and when being specifically formed, the first rear cavity, the front cavity, and the second rear cavity are disposed in a stacked manner along the thickness direction of the kernel. Therefore, the rear cavity is disposed in space of the entire speaker in the thickness direction of the kernel, to reduce an area occupied by the entire speaker in a mobile terminal on the premise that a size of the rear cavity meets a requirement.

When being specifically disposed, the first rear cavity is disposed around the kernel. The first rear cavity may be a U-shaped or ring-shaped cavity.

When the speaker is deformed due to a force, a change of the rear cavity is caused, thereby causing a change of an air pressure. Consequently, air pressures on two sides of a sound film in the kernel are unbalanced, polarization occurs, and noises are generated in the speaker. To improve this situation, a first through hole is disposed on the spacer, the first through hole is in communication with the front cavity and the rear cavity, and the hole is covered with a water resistant and breathable film layer. Therefore, ventilation can be implemented and water can be prevented from entering the rear cavity.

Specifically, the spacer is disposed as a thermally conductive spacer, for example, a metal spacer. For example, the spacer may be a copper spacer, an aluminum spacer, or the like made of a different metal material. Therefore, heat in the rear cavity may be transmitted to the front cavity through the spacer and then is dissipated to the outside. This improves a heat dissipation effect of the entire speaker.

Alternatively, the housing may be in an integrated structure. In a specific implementation solution, the upper cover plate, the lower cover plate, and the side frame are in an integrated structure.

To enable the kernel to be securely fastened when being disposed, a step structure configured to clamp the kernel is disposed on the side frame, a second through hole is disposed on the step structure, and the second through hole is in air communication with the first rear cavity and the second rear cavity. In this way, the first rear cavity and the second rear cavity form a communicated cavity.

During specific disposition, there are two second through holes, and the two second through holes are respectively disposed on two sides of the kernel.

To reduce a size of the speaker in the thickness direction of the kernel, when the upper cover plate is disposed, a third through hole for accommodating the kernel is disposed on the upper cover plate. When the kernel is installed, the third through hole is nested on the kernel.

In order to better improve sound quality of the speaker, a sound-absorbing particle is disposed in the second rear cavity, and an isolation net is disposed on the second through hole, to prevent the sound-absorbing particle from entering the first rear cavity. The isolation net may be any net that can achieve an isolation effect, such as a gauze or a metal net.

According to a second aspect, a speaker is provided. The speaker includes a housing and a kernel located in the housing, where there is a front cavity and a rear cavity in the housing, the front cavity is in communication with the outside, and the rear cavity is an isolated cavity. In addition, to reduce a space area occupied by the entire speaker, the front cavity and the rear cavity are disposed in a stacked manner when being disposed. Specifically, the front cavity and the rear cavity are at least partially stacked along a thickness direction of the kernel. Therefore, the rear cavity is disposed in space of the entire speaker in the thickness direction of the kernel, to reduce an area occupied by the entire speaker in a mobile terminal on the premise that a size of the rear cavity meets a requirement.

When being specifically disposed, the rear cavity is divided into two parts: a first rear cavity and a second rear cavity, and the first rear cavity is in communication with the second rear cavity. When the first rear cavity and the second rear cavity are specifically disposed, the first rear cavity, the front cavity, and the second rear cavity are disposed in a stacked manner along the thickness direction of the kernel. This maximizes a size of the speaker in the thickness direction of the kernel, reduces the area occupied by the speaker in the mobile terminal, and further improves space utilization of the mobile terminal.

The first rear cavity is disposed around the kernel. When being specifically disposed, the first rear cavity is disposed around the kernel. The first rear cavity may be a U-shaped or ring-shaped cavity.

When the front cavity and the rear cavity are specifically formed, the following structure is used. The housing includes a side frame, an upper cover plate, and a lower cover plate disposed opposite to the upper cover plate; a spacer is disposed in the housing, the kernel is disposed between the upper cover plate and the spacer, and the kernel and the spacer are disposed in a stacked manner along the thickness direction of the kernel; the kernel, the spacer, and side walls of the side frame enclose the front cavity, and a sound hole in communication with the front cavity is disposed on a side wall of the side frame; the upper cover plate, side walls of the kernel, and the side walls of the side frame enclose the first rear cavity; and the lower cover plate, the side walls of the side frame, and the spacer enclose the second rear cavity. It can be learned from the foregoing description that the spacer is located between the front cavity and the second rear cavity. Therefore, impact caused by resonance generated by the spacer when speaker works on another component in the mobile terminal can be effectively minimized.

When the speaker is deformed due to a force, a change of the rear cavity is caused, thereby causing a change of an air pressure. Consequently, air pressures on two sides of a sound film in the kernel are unbalanced, polarization occurs, and noises are generated in the speaker. To improve this situation, a first through hole is disposed on the spacer, the first through hole is in communication with the front cavity and the rear cavity, and the hole is covered with a water resistant and breathable film layer. Therefore, ventilation can be implemented and water can be prevented from entering the rear cavity.

Specifically, the spacer is disposed as a thermally conductive spacer, for example, a metal spacer. For example, the spacer may be a copper spacer, an aluminum spacer, or the like made of a different metal material. Therefore, heat in the rear cavity may be transmitted to the front cavity through the spacer and then is dissipated to the outside. This improves a heat dissipation effect of the entire speaker.

Alternatively, the housing may be in an integrated structure. In a specific implementation solution, the upper cover plate, the lower cover plate, and the side frame are in an integrated structure.

To reduce a size of the speaker in the thickness direction of the kernel, when the upper cover plate is disposed, a third through hole for accommodating the kernel is disposed on the upper cover plate. When the kernel is installed, the third through hole is nested on the kernel.

To enable the kernel to be securely fastened when being disposed, a step structure configured to clamp the kernel is disposed on the side frame, a second through hole is disposed on the step structure, and the second through hole is in air communication with the first rear cavity and the second rear cavity.

When the second through hole is specifically disposed, there are two second through holes, and the second through holes are respectively disposed on two sides of the kernel.

In order to better improve sound quality of the speaker, a sound-absorbing particle is disposed in the second rear cavity, and an isolation net is disposed on the second through hole, to prevent the sound-absorbing particle from entering the first rear cavity. The isolation net may be any net that can achieve an isolation effect, such as a gauze or a metal net.

According to a third aspect, a mobile terminal is provided, where the mobile terminal includes the speaker in any one of the foregoing aspects. A front cavity and a rear cavity are at least partially stacked along a thickness direction of a kernel. Therefore, the rear cavity is disposed in space of the entire speaker in the thickness direction of the kernel, to reduce an area occupied by the entire speaker in the mobile terminal on the premise that a size of the rear cavity meets a requirement.

The mobile terminal includes a middle frame, and a mainboard disposed in the middle frame, and further includes a sensor assembly, where a notch for avoiding the sensor assembly and the speaker is disposed on the mainboard.

When being specifically disposed, the speaker is located at a top end inside the middle frame or a bottom end inside the middle frame.

DESCRIPTION OF EMBODIMENTS

To make the objectives, technical solutions, and advantages of this application clearer, the following further describes this application in detail with reference to the accompanying drawings.

To facilitate understanding of a speaker provided in an embodiment of this application, an application scenario of the speaker is first described. The speaker is applied inside a mobile terminal, and the mobile terminal may be a common mobile terminal such as a mobile phone, a tablet computer, or a notebook computer. In addition, the speaker may be applied to a mobile terminal using a single speaker and a mobile terminal using two speakers.

For ease of describing a structure in this embodiment of this application, a coordinate system is established, where an XY plane is a plane on which a placement plane of the speaker disposed in the mobile terminal is located, and a Z direction is a thickness direction of the speaker and is also a thickness direction of a kernel.

First, it should be noted that, stacking described in the embodiments of this application means that two components at least partially overlap each other. To be specific, a vertical projection of one of the two components on a placement plane of the other component at least partially overlaps a vertical projection of the other component on the placement plane of the other component. The two components can partially or completely overlap each other. Sizes of the two stacked components are not limited herein.

Figure 5:
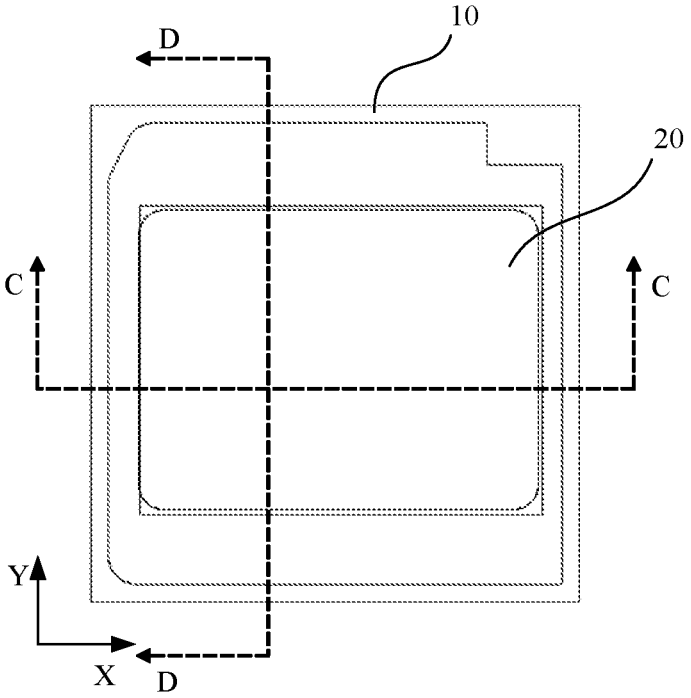
FIG. 5 is a top view of a speaker according to an embodiment of this application.

As shown in FIG. 5, an embodiment of this application provides a speaker. The speaker includes a housing 10 and a kernel 20.

Figure 6:
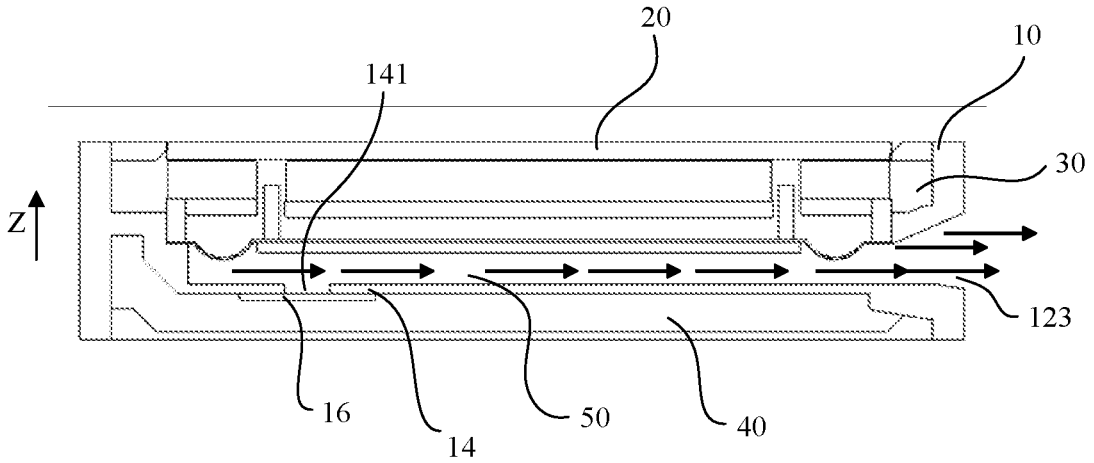
FIG. 6 is a sectional view at a line C-C in FIG. 5.
Figure 7:
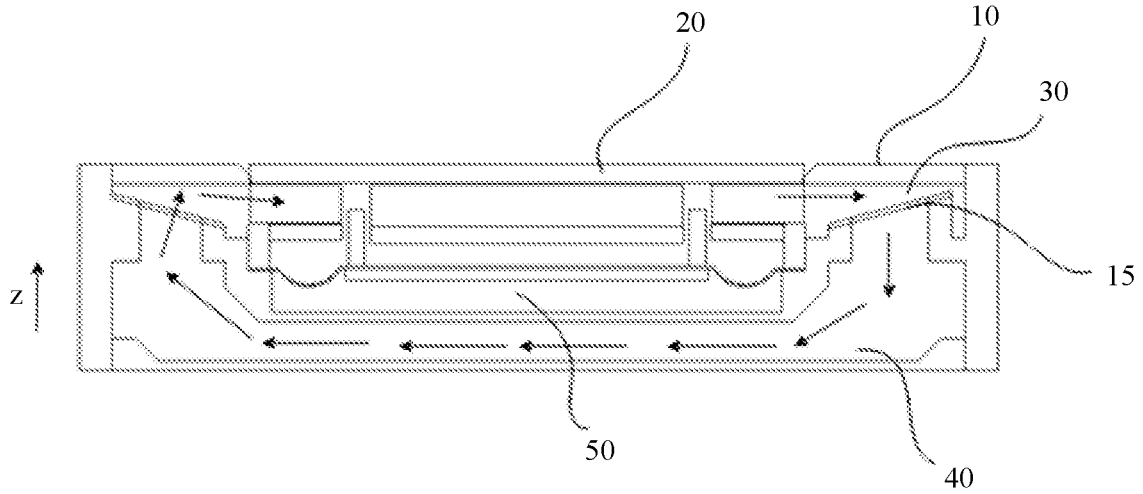
FIG. 7 is a sectional view at a line D-D in FIG. 5.
Figure 8:
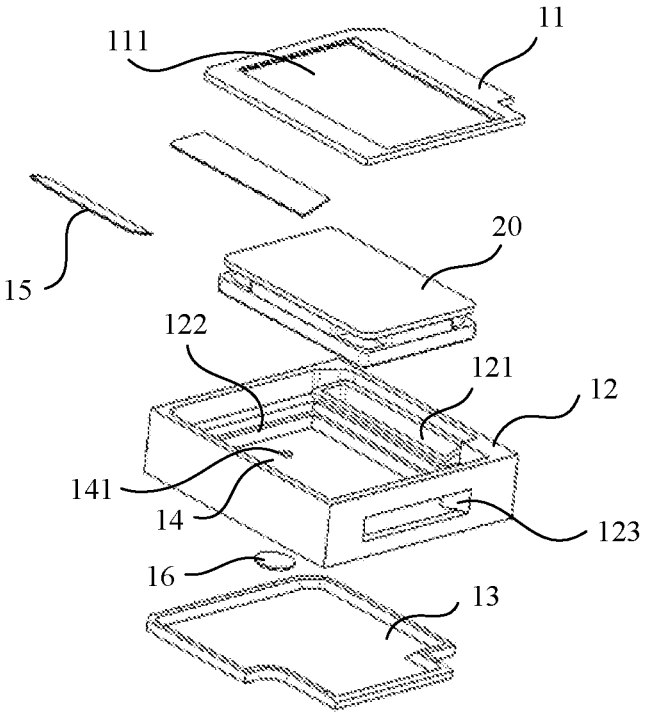
FIG. 8 is a schematic exploded view of a speaker according to an embodiment of this application.

Referring to FIG. 6 to FIG. 8, the housing 10 specifically includes a side frame 12, an upper cover plate 11, and a lower cover plate 13 opposite to the upper cover plate 11. The side frame 12 is a frame structure with openings at two ends, and the upper cover plate 11 and the lower cover plate 13 each cover one opening and enclose the housing 10 with the side frame 12. The side frame 12 shown in FIG. 8 is in a rectangular frame structure. However, it should be understood that the side frame 12 provided in the embodiments of this application is not limited to a rectangle, and may be alternatively in another different structure such as a circle or a polygon. For the housing 10 shown in FIG. 8, the rectangular side frame 12 is merely used as an example for description.

When the upper cover plate 11 and the lower cover plate 13 are disposed, the upper cover plate 11 and the lower cover plate 13 are respectively located on two sides of the side frame 12 and seal the openings of the side frame 12, to form the housing 10. To seal the openings of the side frame 12, the upper cover plate 11 and the lower cover plate 13 each may be fixedly connected to the side frame 12 by using adhesive or in another connection manner.

Alternatively, the housing is not limited to a structure including the foregoing components, and may be alternatively in an integrated structure. In this case, the upper cover plate 11, the lower cover plate 13, and the side frame 12 are in an integrated structure.

Still referring to FIG. 6 to FIG. 8, a spacer 14 is disposed in the housing 10. As shown in FIG. 8, the spacer 14 is fixedly connected to side walls of the side frame 12. When the kernel 20 is disposed in the housing 10, the kernel 20 and the spacer 14 are disposed in a stacked manner along a thickness direction of the kernel 20, and the kernel 20 is disposed between the upper cover plate 11 and the spacer 14.

Referring to FIG. 6 to FIG. 8, to fasten the kernel 20, a protruding step structure 122 is disposed on an inner side wall of the side frame 12. When the step structure 122 is formed, the inner wall of the side frame 12 protrudes towards the inside of the side frame 12 to form a ring-shaped protrusion, and the step structure 122 is formed on the protrusion. When the kernel 20 is placed inside the side frame 12, the kernel 20 is clamped on the step structure 122. In addition, when the spacer 14 is disposed, the spacer 14 is also fixedly connected to the protrusion structure, and is located below the kernel 20 (using a placement direction of the speaker shown in FIG. 6 as a reference direction). It can be seen from FIG. 6 and FIG. 7 that, after the kernel 20 and the spacer 14 are separately fastened to the housing 10, there is a spacing between the kernel 20 and the spacer 14, and the spacing is a front cavity 50. The front cavity 50 is enclosed by the kernel 20, the spacer 14, and the side walls of the side frame 12. In addition, a sound hole 123 in communication with the front cavity 50 is further disposed on a side wall of the side frame 12. A sound emitted by the kernel 20 is transmitted to the outside along a path from the front cavity 50 to the sound hole. Specifically, reference may be made to a sound wave propagation path shown by a straight line with an arrow in FIG. 6.

A height of the front cavity 50 may be specifically limited by a height of the protrusion structure disposed on the side frame 12. The height of the protrusion structure limits a spacing between the kernel 20 and the spacer 14 in a Z direction, that is, limits the height of the front cavity 50.

Still referring to FIG. 6 and FIG. 7, when the kernel 20 is disposed inside the side frame 12 of the housing 10, there is also a spacing between side walls of the kernel 20 and the side walls of the side frame 12, and the spacing forms a first rear cavity 30. In addition, the first rear cavity 30 is enclosed by the upper cover plate 11, the side walls of the kernel 20, and the side walls of the side frame 12. In structures shown in FIG. 6 and FIG. 7, the first rear cavity 30 is ring-shaped space. Alternatively, the first rear cavity 30 may be a U-shaped cavity surrounding the kernel 20, or may be two parallel independent spaces, where the two independent spaces are respectively disposed on two sides of the kernel, or may be a ring-shaped cavity.

Referring to FIG. 7, in the structure shown in FIG. 7, the lower cover plate 13, the side walls of the side frame 12, and the spacer 14 enclose a second rear cavity 40. The second rear cavity 40 and the first rear cavity 30 are in air communication, and form an entire rear cavity of the speaker together. FIG. 7 is a schematic diagram of sound wave flow in a rear cavity. To enable air communication between the first rear cavity 30 and the second rear cavity 40, as shown in FIG. 8, a second through hole 121 is disposed on a side of the step structure 122, and the second through hole 121 is in air communication with the first rear cavity 30 and the second rear cavity 40. As shown in FIG. 7 and FIG. 8, there are two second through holes 121, and the two second through holes 121 are respectively disposed on two sides of the kernel 20. In addition, to avoid the front cavity 50, the second through holes 121 are also disposed on two sides of the front cavity 50. Alternatively, there are a plurality of second through holes 121, and the plurality of second through holes are arranged in two rows that are respectively located on two sides of the kernel 20. Alternatively, there is one second through hole 121, and the second through hole is disposed around the kernel 20.

Figure 10:
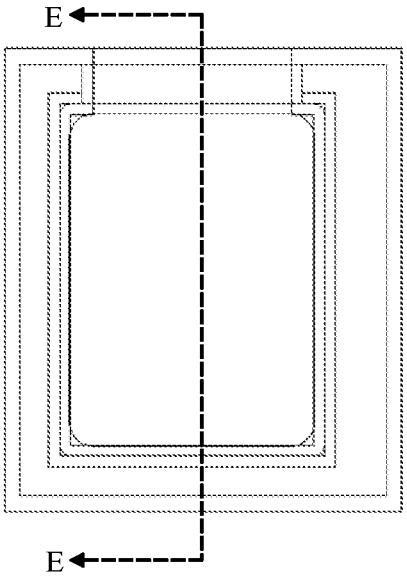
FIG. 10 is another schematic structural diagram of a speaker according to an embodiment of this application.
Figure 11:
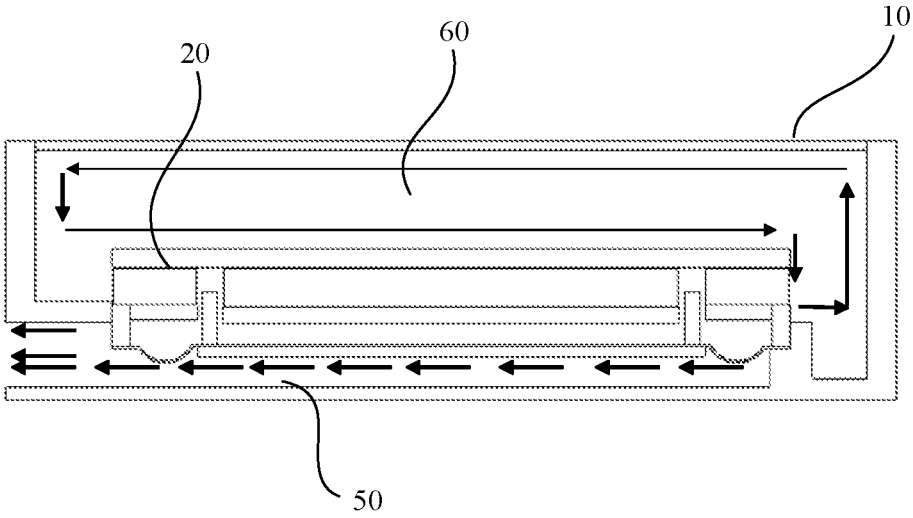
FIG. 11 is a sectional view at a line E-E in FIG. 10.

It can be learned from the foregoing description that when the first rear cavity 30, the front cavity 50, and the second rear cavity 40 are disposed, as shown in FIG. 6, the first rear cavity 30, the front cavity 50, and the second rear cavity 40 are stacked in the Z direction, and the three cavities partially overlap each other. Certainly, an arrangement manner of the front cavity and the rear cavity is not limited to the foregoing manner, and another manner may be used. Alternatively, FIG. 10 and FIG. 11 show another arrangement manner of the rear cavity and the front cavity. FIG. 10 shows another speaker according to an embodiment of this application. FIG. 11 shows a sectional view at a line E-E in FIG. 10. It can be learned from FIG. 11 that a rear cavity 60 uses an integral structure, and the front cavity 50 is separated from the rear cavity 60 through the kernel 20. The rear cavity 60 is located above the kernel 20 (in the Z direction), and the front cavity 50 is located below the kernel 20. In other words, the front cavity 50 is isolated from the rear cavity 60 through the kernel 20. When this manner is used, the rear cavity 60 is isolated from the front cavity 50.

Figure 1:
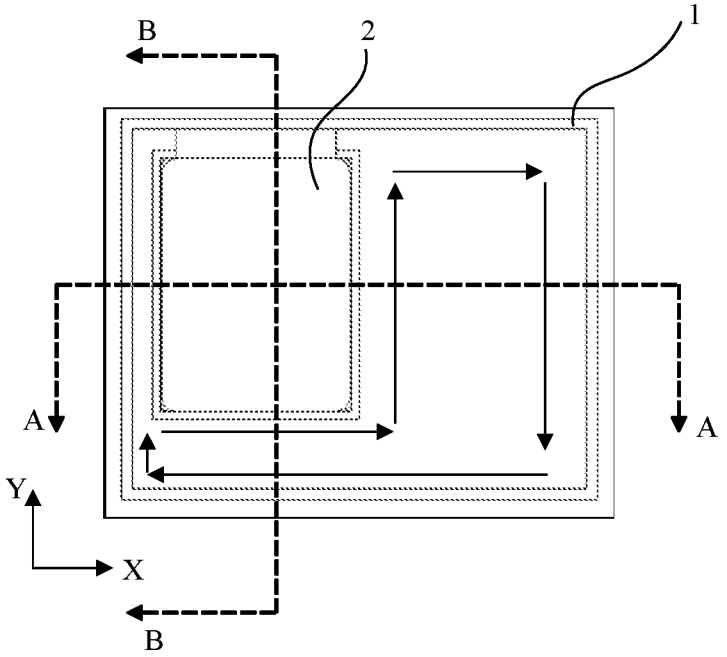
FIG. 1 is a schematic structural diagram of a speaker in the prior art.
Figure 2:
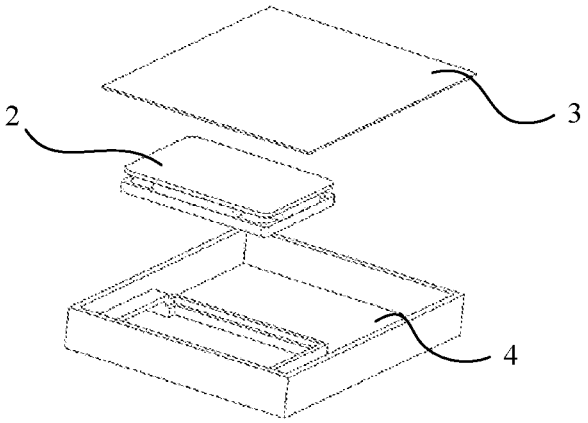
FIG. 2 is a schematic exploded view of a speaker in the prior art.
Figure 3:
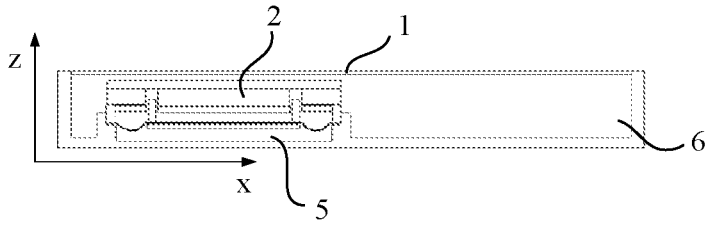
FIG. 3 is a sectional view at a line A-A in FIG. 1.
Figure 4:
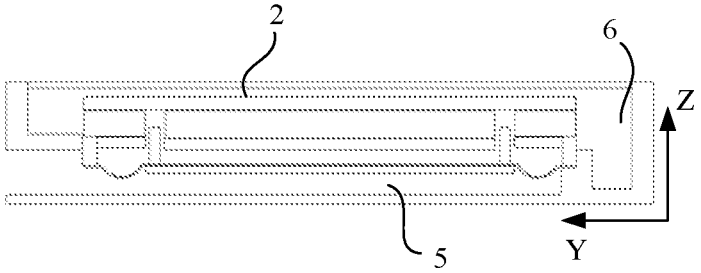
FIG. 4 is a sectional view at a line B-B in FIG. 1.

FIG. 3 shows a width of a speaker in an X direction in the prior art. FIG. 7 shows a width of the speaker in an X direction according to the embodiment of this application. It can be learned from FIG. 3 that the width of the speaker in the prior art mainly includes two sizes: a width of a front cavity 5 and a width of a rear cavity 6. In the speaker provided in the embodiment of this application, the first rear cavity 30 is disposed around the kernel 20, and the first rear cavity 30 and the second rear cavity 40 are respectively located on the two sides of the front cavity 50. In addition, a space area of the first rear cavity 30 is far less than that of the second rear cavity 40. Therefore, the width in the X direction is mainly a width of the front cavity 50. On a premise that space of the rear cavity provided in the embodiment of this application is the same as that of the rear cavity in the prior art, it can be learned that a size of the speaker provided in the embodiment of this application in the X direction is far less than that of the speaker in the prior art in the X direction. As shown in FIG. 4 and FIG. 6, a size of the speaker provided in the embodiment of this application in the Y direction is similar to that of the speaker in the prior art in the Y direction. Therefore, when the structure in which the rear cavity and the front cavity 50 are partially stacked with each other is used, an area occupied by the speaker on an XY plane can be greatly reduced. This improves space utilization of the mobile terminal.

In addition, to reduce a thickness increased in the Z direction of the foregoing structure, as shown in FIG. 8, a third through hole 111 for accommodating the kernel 20 is disposed on the upper cover plate 11 when the upper cover plate 11 is disposed. When the kernel 20 is installed, the third through hole 111 is nested on the kernel 20. In addition, side walls of the third through hole 111 are sealed with the kernel 20 by using sealant or another sealing piece. Referring to both FIG. 3 and FIG. 7, it can be seen from FIG. 3 that, when a kernel 2 in the prior art is assembled in the housing 1, there is a specific spacing between the kernel 2 and the top of the housing 1. However, in the embodiment of this application shown in FIG. 7, the upper cover plate 11 is nested on the kernel 20. Therefore, even if a structure in which the front cavity 50 is stacked with the first rear cavity 30 and the second rear cavity 40 is used in the speaker provided in the embodiment of this application, the third through hole 111 disposed on the upper cover plate 11 can effectively help reduce impact caused by stacking of the three cavities on a size of the speaker in the Z direction. Therefore, the size of the entire speaker is further reduced.

When the speaker provided in the embodiment of this application uses the foregoing stacking structure of the cavities, in addition to the foregoing effect of reducing an area occupied by the speaker in the mobile terminal, a sound quality effect of the speaker can be further improved. Specifically, for the speaker, when a sound film of the kernel 20 vibrates, resonance is extremely easily caused to a side wall that is in the front cavity 50 and that faces the sound film of the kernel 20. However, for the speaker shown in FIG. 3, a side wall of the speaker that faces the sound film is located on the housing 1. When the speaker is fastened, the side wall needs to be connected to another component (for example, a mainboard or a frame) in the mobile terminal. This causes resonance of the component to which the speaker is fastened. Consequently, noises are generated, and a sound quality effect of the speaker is affected. However, for the speaker in the embodiment of this application, as shown in FIG. 6, a side wall that is in the front cavity 50 in the speaker and that faces the sound film is the spacer 14, and the spacer 14 is surrounded by the front cavity 50 and the second rear cavity 40 and is isolated by the housing 10. Therefore, when the spacer 14 generates resonance because of impact of the sound film, resonance does not occur on a component outside the speaker. This avoids noises generated by the speaker during sound production, and further improves a sound quality effect of the speaker.

For the cavities provided in the embodiment of this application, as shown in FIG. 6, FIG. 7, and FIG. 8, the front cavity 50 is in communication with the outside through the sound hole 123, and the rear cavity is relatively enclosed space. When the speaker is deformed because of an external force, space of the rear cavity changes. Because the rear cavity is relatively enclosed, an air pressure in the rear cavity changes. Consequently, air pressures on both sides of the sound film are unbalanced, and polarization occurs. Therefore, when the speaker works, noises are extremely easily generated, and a sound quality of the speaker is affected. To resolve the foregoing problem, in a specific embodiment, a first through hole 141 is disposed on the spacer 14. As shown in FIG. 8, the first through hole 141 is a circular through hole, and the front cavity 50 may be in communication with the rear cavity through the first through hole 141. When the air pressure in the rear cavity changes, the first through hole 141 may be used to maintain balance between the air pressure in the front cavity 50 and the air pressure in the rear cavity. This avoids polarization of the sound film, and improves a sound quality effect of the speaker. In addition, because the front cavity 50 is in communication with the outside, when the front cavity 50 is in communication with the rear cavity through the first through hole 141, to prevent external water vapor from entering the rear cavity, a water resistant and breathable film 16 is disposed on the first through hole 141. In this way, air exchange between the front cavity 50 and the rear cavity can be achieved, and adverse impact on the entire speaker caused by external water vapor entering the rear cavity is avoided. It should be understood that the circular first through hole 141 shown in FIG. 8 is merely an example. The first through hole 141 provided in this embodiment of this application may be a hole in another different shape, such as a rectangle or an ellipse.

When the speaker works, heat is inevitably generated. During heat dissipation, heat in the front cavity may be directly dissipated to the outside through the sound hole. However, for the rear cavity, the rear cavity in the prior art is completely located inside the mobile terminal, and heat dissipation of the rear cavity completely depends on a heat dissipation component of the mobile terminal. Consequently, relatively large power consumption is caused. However, because the cavity stacking structure is used in the embodiment of this application, the heat in the rear cavity may be dissipated through the front cavity 50. Specifically, the spacer 14 is disposed as a thermally conductive spacer 14, for example, a metal spacer. For example, the spacer 14 may be a copper spacer, an aluminum spacer, or the like made of a different metal material. Therefore, the heat in the rear cavity may be transmitted to the front cavity 50 through the spacer 14 and then is dissipated to the outside. This improves a heat dissipation effect of the speaker and reduces power consumption of the entire mobile terminal.

Figure 9:
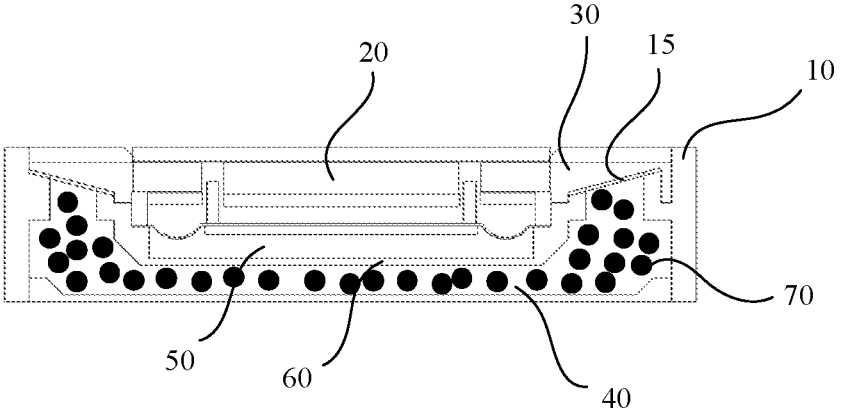
FIG. 9 is another schematic structural diagram of a speaker according to an embodiment of this application.

To further improve a sound quality effect of the entire speaker, as shown in FIG. 9, sound-absorbing particles 70 are disposed in the second rear cavity 40, so that an FO index of the same cavity is reduced (where FO refers to a frequency corresponding to a first maximum value of a speaker impedance curve, and a smaller FO brings better low-frequency sensitivity). This brings better sound quality, frequency response, and sound reproduction, and improves sound quality of the speaker. In addition, during specific disposition, to prevent the sound-absorbing particle 70 from entering the kernel 20 through the first rear cavity 30, an isolation net 15 is disposed on the second through hole 121 for isolation. The isolation net 15 may be made of different materials, and may be any net that can achieve an isolation effect, such as a gauze or a metal net. In addition, an aperture of the isolation net 15 should be less than a diameter of the sound-absorbing particle 70, to achieve an isolation effect.

It should be understood that the foregoing examples are merely an example of the speaker provided in the embodiment of this application. Any structure described as follows can be applied to the speaker provided in the embodiment of this application. The structure is disposed in a manner in which a front cavity and a rear cavity are stacked, and specifically the front cavity and the rear cavity are at least partially stacked with each other along a thickness direction of a kernel, to dispose the rear cavity in space of the entire speaker in the thickness direction of the kernel, and reduce an area occupied by the entire speaker in the mobile terminal on the premise that a size of the rear cavity meets a requirement.

An embodiment of this application further provides a mobile terminal. The mobile terminal may be a common mobile terminal such as a mobile phone, a tablet computer, or a notebook computer. In addition, the mobile terminal includes the speaker 100 according to any one of the foregoing embodiments. A front cavity 50 and a rear cavity are disposed in an at least partially stacking manner. Therefore, the rear cavity is disposed in space of the entire speaker 100 in a thickness direction of a kernel 20, to reduce an area occupied by the entire speaker 100 in the mobile terminal on the premise that a size of the rear cavity meets a requirement.

Figure 12:
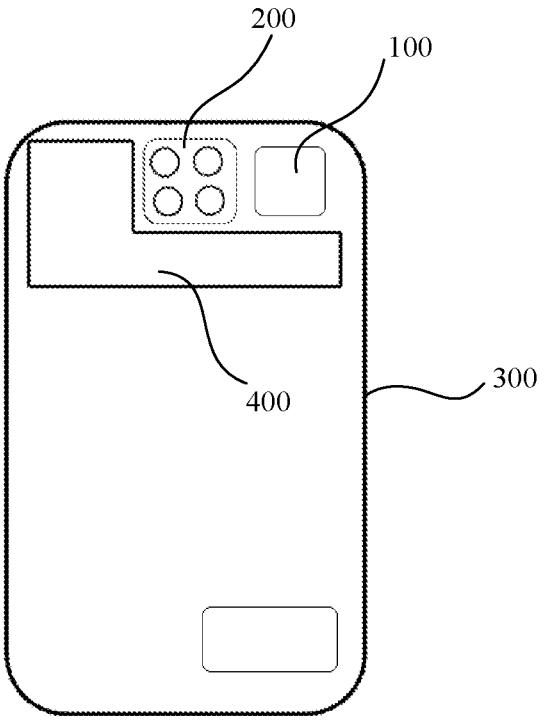
FIG. 12 is a schematic structural diagram of a mobile terminal according to an embodiment of this application.

As shown in FIG. 12, the mobile terminal includes the speaker 100, a mainboard 400, and a sensor assembly 200. The foregoing components are stacked on a middle frame 300 of the mobile terminal by screws, fasteners, adhesive, or the like. In addition, a notch for avoiding the sensor assembly 200 and the speaker 100 is disposed on the mainboard 400. When a stackable area of the middle frame 300 is fixed, available spaces of the components affect each other. However, in the embodiments of this application, because the cavities are disposed in a stacked manner, a space area occupied by the cavities in the speaker 100 is reduced, and the sensor assembly 200 can be disposed on a central axis of the mobile terminal. This can increase an area of the mainboard 400.

Figure 13:
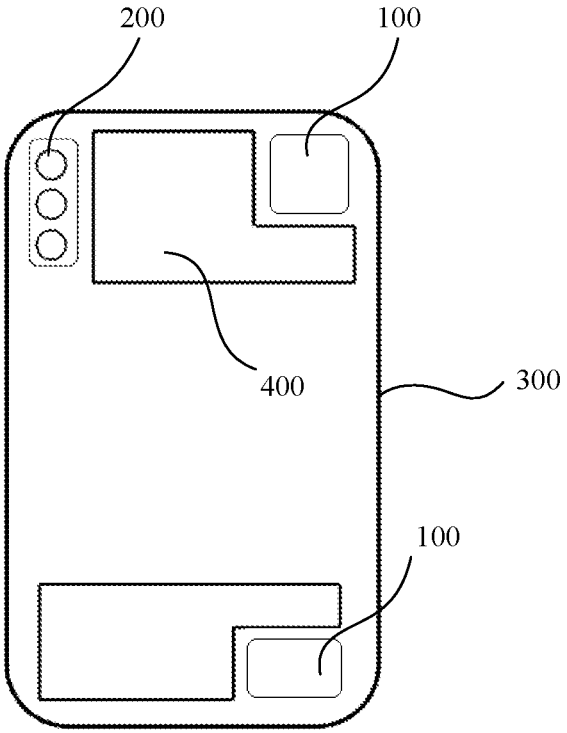
FIG. 13 is another schematic structural diagram of a mobile terminal according to an embodiment of this application.

As shown in FIG. 13, when the sensor assembly 200 in the mobile terminal is disposed on one side of the middle frame 300, an arrangement manner of the mainboard 400, the speaker 100, and the sensor assembly 200 is as follows: the sensor assembly 200, the mainboard 400, and the speaker 100. When the arrangement manner is used, an area of the mainboard 400 may be increased as an area occupied by the speaker 100 is reduced. This improves space utilization of the entire mobile terminal.

FIG. 12 and FIG. 13 show a case in which the speaker 100 is located at the top of the mobile terminal. When the speaker 100 is located at the bottom of the mobile terminal, utilization of the mobile terminal can be also improved. As shown in FIG. 13, when the speaker 100 is disposed at the bottom of the mobile terminal, an area of the mainboard 400 may be increased as space occupied by the speaker 100 is reduced. This improves space utilization of the mobile terminal.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A speaker, comprising a housing and a kernel, wherein:

the housing comprises a side frame, an upper cover plate, and a lower cover plate disposed opposite to the upper cover plate;

a spacer is disposed in the housing, the kernel is disposed between the upper cover plate and the spacer, and the kernel and the spacer are disposed in a stacked manner along a thickness direction of the kernel;

the kernel, the spacer, and side walls of the side frame form a front cavity, and a sound hole in communication with the front cavity is disposed on a side wall of the side frame;

the upper cover plate, side walls of the kernel, and the side walls of the side frame form a first rear cavity;

the lower cover plate, the side walls of the side frame, and the spacer form a second rear cavity, and the first rear cavity is in communication with the second rear cavity through a hole; and the front cavity and the second rear cavity are disposed in a stacked manner along the thickness direction of the kernel.

2. The speaker of claim 1, wherein the first rear cavity is configured to encircle the kernel.

3. The speaker of claim 1, wherein the first rear cavity forms a U shape or a circular shape.

4. The speaker of claim 1, wherein the spacer has a first hole and a film is disposed on the first hole.

5. The speaker of claim 1, wherein the spacer is a heat-conducting spacer.

6. The speaker of claim 1, wherein the side frame, the upper cover plate, and the lower cover plate form a uni-body structure.

7. The speaker of claim 1, wherein a third hole for accommodating the kernel is disposed on the upper cover plate.

8. The speaker of claim 1, wherein a step structure configured to receive the kernel is disposed on the side frame, at least a second hole is disposed on the step structure, and the second hole is in air communication with the first rear cavity and the second rear cavity.

9. The speaker of claim 8, wherein the at least one second hole includes two second holes corresponding to two sides of the kernel, respectively.

10. The speaker of claim 8, wherein a sound-absorbing particle is disposed in the second rear cavity, and an isolation net is disposed on the second through hole.

11. A speaker assembly, comprising:

a kernel configured to produce sound waves;

a housing having a first opening configured to receive the kernel and a second opening configured to release the sound waves produced by the kernel, the housing having a first, second, and third dimensions; and a spacer disposed under the kernel along the third dimension of the housing and between the housing and the kernel, wherein the kernel, the housing, and the spacer form a front cavity in communication with a second hole of the housing and configured to direct the sound waves to the second hole, wherein the kernel and the housing form a rear cavity around the kernel and configured to direct the sound waves from the kernel to the front cavity, and wherein the front cavity and the rear cavity are arranged in a stacked manner along the third dimension of the housing.

12. The speaker assembly of claim 11, wherein the front cavity is formed between the kernel and the rear cavity along the third dimension of the housing.

13. The speaker assembly of claim 11, wherein:

the housing comprising a frame, an upper cover plate, and a lower cover plate, the first opening is disposed on the upper cover plate; and the second opening is disposed on a side wall of the frame.

14. The speaker assembly of claim 13, wherein:

the frame, the kernel, and the spacer form the front cavity, and the frame, the upper cover plate, the lower cover plate, and the kernel form the rear cavity.

15. The speaker assembly of claim 14, wherein:

the rear cavity includes a first rear cavity and a second rear cavity, the frame, the upper cover plate, and the kernel form the first rear cavity, and the frame and the lower cover plate form the second rear cavity.

16. The speaker assembly of claim 15, wherein the front cavity is formed between the kernel and the second rear cavity along the third dimension of the housing.

17. The speaker assembly of claim 15, wherein the first rear cavity has a U shape or a ring shape.

18. The speaker assembly of claim 11, wherein the housing includes a step configured to support the kernel.

19. The speaker assembly of claim 18, wherein the step includes a hole configured to transmit the sound waves from the first rear cavity to the second rear cavity.

20. A terminal device, comprising:

a processor;

a display screen; and a speaker assembly, the speaker assembly having:

a kernel configured to produce sound waves;

a housing having a first opening configured to receive the kernel and a second opening configured to release the sound waves produced by the kernel, the housing having a first, second, and third dimensions with the first and second dimensions being greater than the third dimension; and a spacer disposed under the kernel along the third dimension of the housing and between the housing and the kernel, wherein the kernel, the housing, and the spacer form a front cavity in communication with a second hole of the housing and configured to direct the sound waves to the second hole, wherein the kernel and the housing form a rear cavity around the kernel and configured to direct the sound waves from the kernel to the front cavity, and wherein the front cavity and the rear cavity are arranged in a stacked manner along the third dimension of the housing.

* * * * *